US006536767B1

(12) United States Patent
Keller

(10) Patent No.: US 6,536,767 B1
(45) **Date of Patent: *Mar. 25, 2003**

(54) BLACKJACK ROYAL

(76) Inventor: David Keller, 8070 W. Russell Rd., Las Vegas, NV (US) 89113

( * ) Notice: Subject to any disclaimer, the term of this patent is extended or adjusted under 35 U.S.C. 154(b) by 0 days.

This patent is subject to a terminal disclaimer.

(21) Appl. No.: 09/565,213

(22) Filed: May 4, 2000

(51) Int. Cl.[7] ..... A63F 1/00
(52) U.S. Cl. ..... 273/292; 273/274; 463/12
(58) Field of Search ..... 273/236, 274, 273/292; 463/12, 13

(56) References Cited

U.S. PATENT DOCUMENTS 5,174,579 A * 12/1992 Griffiths
5,577,731 A * 11/1996 Jones
5,636,843 A * 6/1997 Roberts
5,743,532 A * 4/1998 Lafferty
5,799,946 A * 9/1998 Groussman
5,806,846 A * 9/1998 Lofink et al.
5,816,575 A * 10/1998 Keller
6,158,741 A * 12/2000 Koelling

* cited by examiner

*Primary Examiner*—Benjamin H. Layno
*Assistant Examiner*—Vishu K Mendiratta
(74) *Attorney, Agent, or Firm*—Rob L. Phillips; Quirk & Tratos

(57) ABSTRACT

In a variation of Blackjack, a player may make a side bet on a dealer's face up card having a point value of ten and a plurality of side bets relating to a player's first two dealt cards.

10 Claims, 2 Drawing Sheets

BLACKJACK ROYAL

BACKGROUND OF THE INVENTION

1. Field of Invention

This invention is in the general field of casino gaming and, more particularly, is a variation of the game of Blackjack.

2. Description of the Prior Art

Blackjack is a card game typically played in a casino at a semicircular table. Usually, seven player stations are equally spaced near an arcuate edge of the table. On the table top near each player station is an imprint of a circle where a player places cheques representative of a Blackjack bet. The dealer is positioned near a straight edge of the table. The dealer faces the players.

Blackjack is played with one or more standard decks of cards. When the player is dealt an ace, it has a point value of either "1" or "11" at the election of the player; a face card (jack, queen or king) has a point value of "10" and the remaining cards ("2" through "10") have their "pip" or number value. The point values of cards held by the player and the point values of cards held by the dealer are, respectively, are added to obtain a player total point value and a dealer total point value.

After the cheques are placed within the imprinted circle, each of the players and the dealer are dealt a hand comprised of two cards. The cards of the player's hand are dealt face-up. A first card of the dealer's hand is dealt face-down. A second card of the dealer's hand is dealt face-up. The dealer ascertains the point value of the face-down card without revealing it to the player.

When the player's hand has a total point value of "21", the player is said to have Blackjack. Correspondingly, when the dealer's hand has the total point value of "21", the dealer is said to have Blackjack whereupon the face-down card is turned face-up.

When the dealer has Blackjack, the dealer wins the Blackjack bet with two exceptions. The first exception occurs when the player has Blackjack whereupon the cheques representative of the Blackjack bet are returned to the player. The first exception is an example of when the player hand and the dealer hand have the same total point value and is referred to as a push.

A second exception occurs when the dealer's face up card is an ace and the player posts cheques representative of what is known as an insurance bet. The insurance be typically equals one half of the Blackjack bet. When the dealer does not have Blackjack, the player loses the insurance bet. When the dealer has Blackjack, the cheques representative of the Blackjack bet and the insurance bet are returned to the player.

The insurance bet is an example of what is known as a side bet. Moreover, the insurance bet is traditionally the only side bet that the player may make. The probability is one in thirteen that the dealer's face up card is an ace. Therefore, the insurance bet cannot be made very often. It should be appreciated that a variety of side bets that may frequently be made would increase the player's interest in Blackjack When the player has Blackjack and the dealer does not, the player wins the Blackjack bet. When neither the dealer nor the player have blackjack, the player has four options.

A first option is to have the player hand augmented by an additional card (referred to as a "hit"). The player may have successive hits until the total point value of the player hand exceeds "21". When the total point value of a hand exceeds "21" it is said to bust. The player loses the Blackjack bet when the player hand busts.

A second option is not to have the player hand augmented by the additional card (referred to as a "stand"). The player may stand at any time that the player hand has not busted.

A third option is available when the player hand is comprised of two cards that are a pair, such as a pair of queens, for a example. The player may split the pair into first and second player hands. An additional card is dealt to the first player hand and to the second player hand, each of which are played as described hereinbefore.

A fourth option is typically available when the player's hand is comprised of two cards that have a total point value of either ten or eleven. The player is permitted to double the Blackjack bet and receive only one additional card.

The decision to hit or stand is made with an objective of causing the player hand to have a total point value closer to "21" than the total point value of the dealer hand without busting. It should be understood that central factors in making the decision are the dealer's face-up card and the total point count of the player hand.

After the player stands, the dealer's face-down card is turned face-up, whereby both cards of the dealer hand are face-up. When the dealer hand has a total point count of less than "17" the dealer must hit, until the dealer hand has a total point count of at least "17". When a hit causes the dealer hand to bust and the player hand has not busted, the player wins the Blackjack bet.

When neither the player hand nor the dealer hand busts and the total point value of the dealer hand exceeds the total point value of the player hand, the dealer wins and vice versa. When there is a push, there is no winner; the cheques representative of the Blackjack bet are returned to the player.

Because the only side bet is the insurance bet, Blackjack may rapidly become tiresome to the player. The incorporation of side bets into Blackjack would increase player interest and, correspondingly, increase revenue of the casino.

SUMMARY OF THE INVENTION

An object of the present invention is to increase the number of side bets available to a Blackjack player.

According to a first aspect of the invention, prior to cards being dealt, a player is given an option of making a line bet that the face up card of a dealer has a point value of ten.

According to a second aspect of the present invention, prior to cards being dealt, the player is given an option of making any of a plurality of side bets relating to the player's first two dealt cards. The side bets include a bonus bet that either one or both of the player's cards have one of two predetermined ranks in a predetermined suit.

The invention gives the player an option of making a side bet in a Blackjack game at a frequency that is heretofore unknown, thereby increasing the interest of the player and revenue of a casino where the Blackjack game is played.

Other objects, features, and advantages of the invention should be apparent from the following description of the preferred embodiment thereof as illustrated in the accompanying drawing.

DESCRIPTION OF THE PREFERRED EMBODIMENT

Blackjack Roy'al is a variation of the well known game of o Blackjack. In Blackjack Roy'al,a player has an option of making a number of side bets. The side bets increase both player interest and revenue at a host casino.

Figure 1:
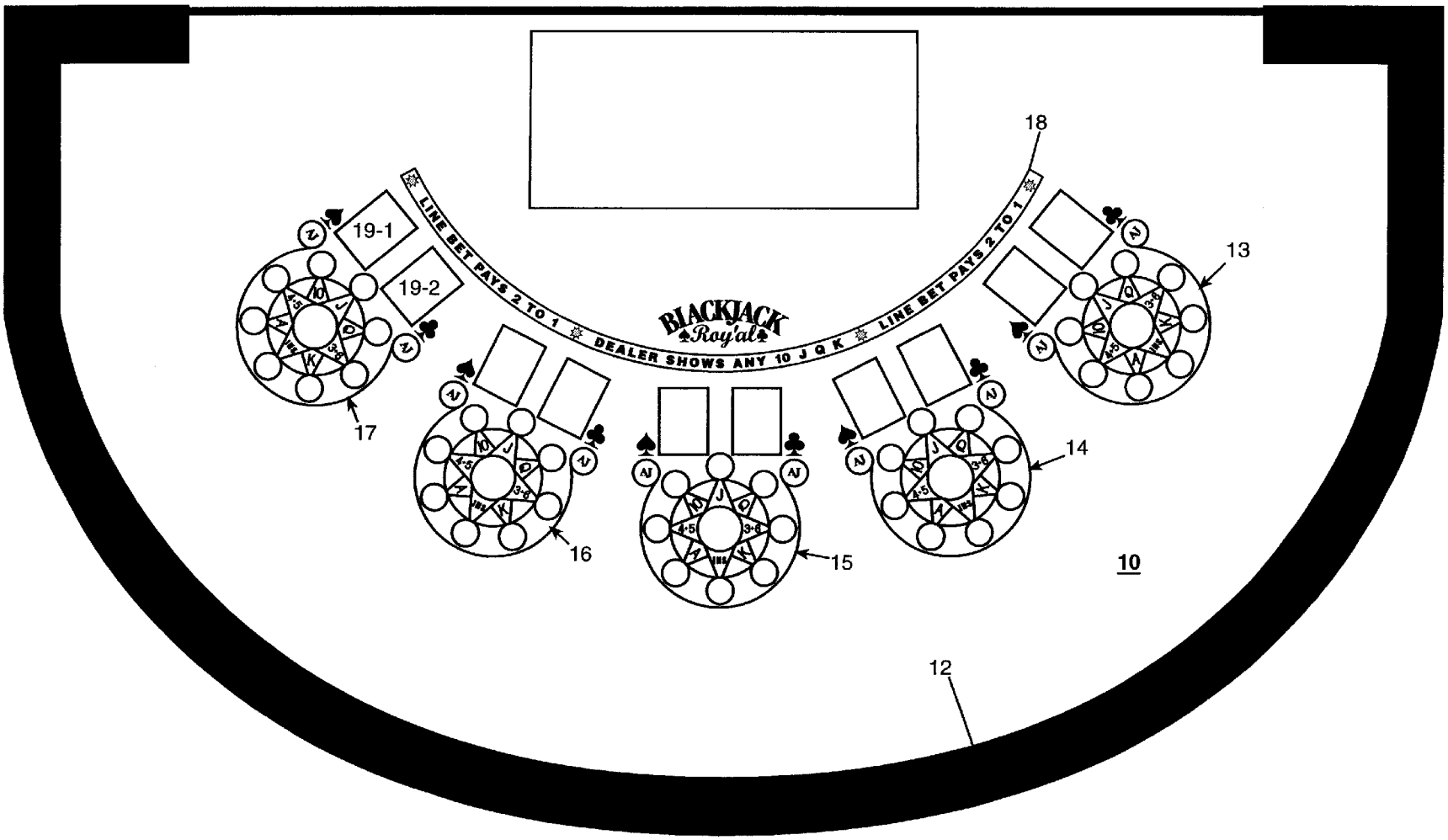
FIG. 1 is a plan view of a table top used in playing a game of Blackjack Roy'al in accordance with the invention.

As shown in FIG. 1, Blackjack Roy'al is played on a table top 10 with an arcuate edge 12. The table top 10 carries imprinted player palettes 13–17 with even spacing therebetween. The palettes 13–17 are similar. Each of the palettes 13–17 is proximal to a player station (not shown) adjacent to the edge 12.

Within an imprint of an arcuate region 18 on the table top 10 is lettering of the phrase, LINE BET PAYS 2 TO 1 and the phrase, DEALER SHOWS ANY 10 J Q K. A player has an option of making a type of side bet, known as a line bet, by placing cheques representative of money within the region 18 prior to cards being dealt. When the player makes the line bet and the dealer is dealt a face up card that has a point value of ten (a ten, jack, queen or king) the player wins a 2 to 1 payout.

Figure 2:
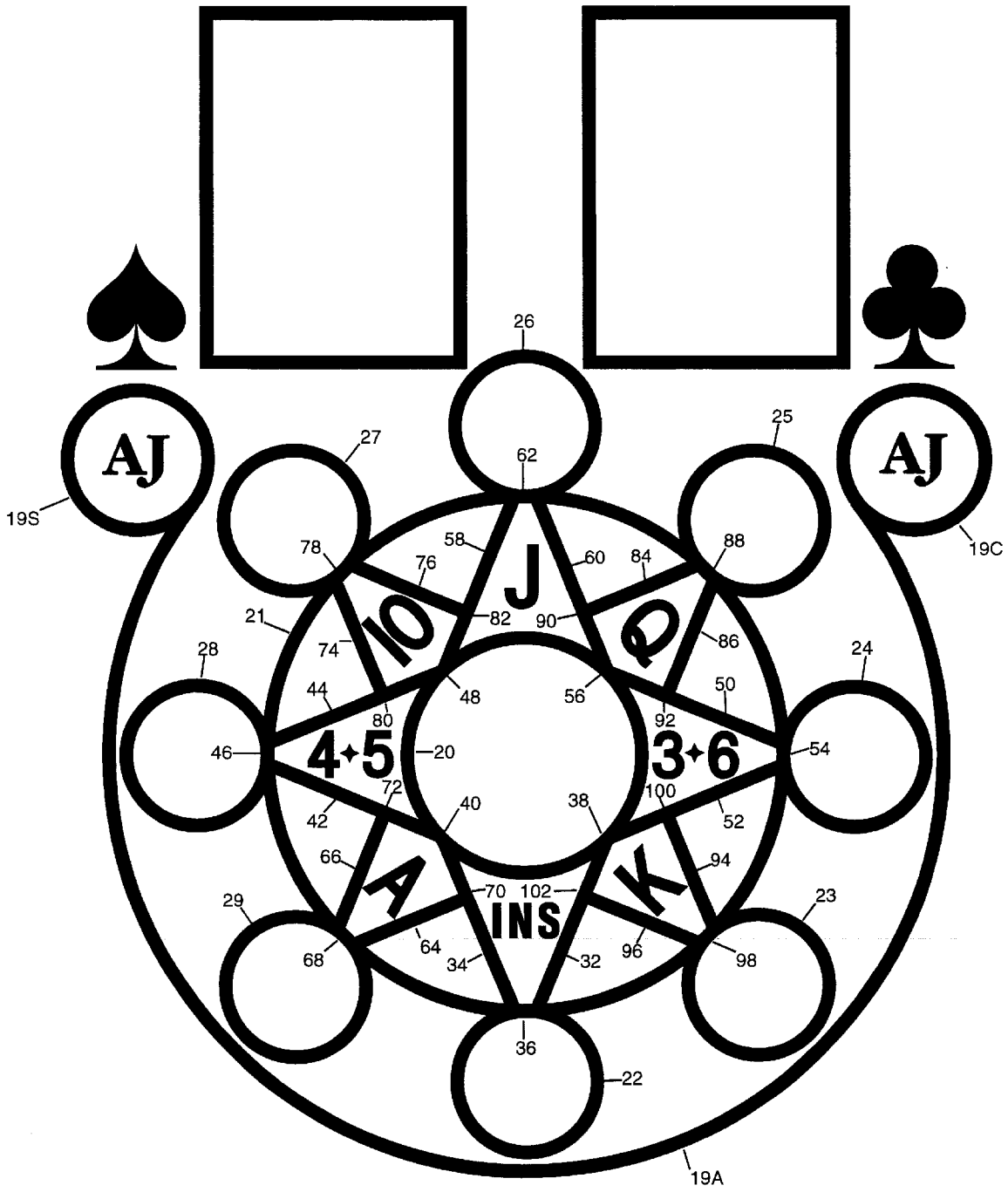
FIG. 2 is an enlarged view of a player station on the table top of FIG. 1.

As shown in FIG. 2, exemplary of the palettes 13–17, the palette 13 includes circles 19S, 19C that are connected by an arc 19A. Proximal to the circles 19S, 19C are the symbols, ♠(spade), ♣(club), respectively. Prior to cards being dealt the player has an option of making what is called a spade bonus bet by placing cheques within the circle 19S.

The player's first and second dealt cards are placed within rectangles 19-1 and 19-2, respectively. When the cards are dealt from multiple standard decks that are shuffled together and the player's first two dealt cards include an A♠ and/or a J♠ the player wins the spade bonus bet and receives a payout in accordance with TABLE I.

TABLE I

| CARDS | | PAYOUT |
|---|---|---|
| J♠ | X | 5 to 1 |
| A♠ | X | 5 to 1 |
| J♠ | J♠ | 100 to 1 |
| A♠ | A♠ | 100 to 1 |
| A♠ | J♠ | 500 to 1 |

When the cards are dealt from a standard deck and the player wins the spade bonus bet, the payout is in accordance with TABLE II .

TABLE II

| CARDS | | PAYOUT |
|---|---|---|
| J♠ | X | 6 to 1 |
| A♠ | X | 6 to 1 |
| A♠ | J♠ | 500 to 1 |

Prior to the cards being dealt the player has an option of making what is called a club bonus bet by placing cheques within the circle 19C. The spade and club bonus bets are identical.

The palette 13 additionally includes a circle 20 where the player posts cheques representative of a Blackjack bet, similar to the posting of the blackjack bet in the prior art. The circle 20 is concentrically positioned within a circle 21.

The palette 13 includes similar circles 22–29 that are circularly disposed about the exterior of the circle 21 with an equal arcuate spacing therebetween. Additionally, the circles 22–29 have a tangential relationship with the circle 21. As explained hereinafter, the player has an option of placing cheques within any of the circles 22–29 to make a side bet On the interior of the circle 21 are lines 32, 34 that intersect at a point 36 where the circle 22 is tangent to the circle 21. The lines 32, 34 are of equal length and extend to points 38, 40, respectively, on the circle 20. Between the lines 32, 34 the palette are the letters, INS, thereby indicating that the player places cheques within the circle 22 to make an insurance bet of a type similar to an insurance bet in the prior art.

On the interior of the circle 21 are lines 42, 44 that intersect at a point 46 where the circle 28 is tangent to the circle 21. The lines 42, 44 are of equal length and extend to the point 40 and a point 48, respectively, on the circle 20. The palette 13 are the characters 4*5 between the lines 42, 44.

Prior to the cards being dealt, the player has an option of making what is called a 4*5 side bet by placing cheques within the circle 28. When the player's first two dealt cards are a four and/or a five of any suit, the player wins the 4*5 bet and receives a payout in accordance with TABLE III.

TABLE III

| CARDS | | PAYOUT |
|---|---|---|
| 4 | X | 2 TO 1 |
| 5 | X | 2 TO 1 |
| 4 | 4 | 7 to 1 |
| 5 | 5 | 7 to 1 |
| 4 | 5 | 7 TO 1 |

On the interior of the circle 21 are lines 50, 52 that intersect at a point 54 where the circle 24 is tangent to the circle 21. The lines 50, 52 are of equal length and extend to a point 56 and the point 38, respectively, on the circle 20. Between the lines 50, 52 the palette 13 are the characters 3*6.

Prior to the cards being dealt, the player has an option of making what is called a 3*6 side bet by placing cheques within the circle 24. The 3*6 bet corresponds to the 4*5 bet described hereinbefore.

On the interior of the circle 21 are lines 58, 60 that intersect at a point 62 where the circle 26 is tangent to the circle 21. The lines 58, 60 are of equal length and extend to the points 48, 56, respectively, on the circle 20. Between the lines 58, 60 is the letter, J.

Prior to the cards being dealt, the player has an option of making a card selection side bet on a jack by placing checks within the circle 26. When the player's first two dealt cards include either one or two jacks of any suit, he player wins the card selection bet on the Jack. More particularly, when one of the first two dealt cards is a jack, the player receives a 5 to 1 payout. When both of the first two dealt cards are jacks, the player receives a 20 to 1 payout.

On the interior of the circle 21 are lines 64, 66 that intersect at a point 68 where the circle 29 is tangent to the circle 21. The lines 64, 66 are of equal length. The line 64 extends to a point 70 on the line 34. The line 66 extends to a point 72 on the line 42. Between the lines 64, 66 is the letter, A. Prior to the cards being dealt, the player has an option of making a card selection bet on an ace by placing cheques within the circle 29.

On the interior of the circle 21 are lines 74, 76 that intersect at a point 78 where the circle 27 is tangent to the circle 21. The lines 74, 76 are of equal length. The line 74 extends to a point 80 on the line 44. The line 76 extends to a point 82 on the line 58. Between the lines 74, 76 is the numeral, 10. Prior to the cards being dealt, the player has an option of making a card selection bet on a ten by placing cheques within the circle 27.

On the interior of the circle 21 are lines 84, 86 that intersect at a point 88 where the circle 25 is tangent to the circle 21. The lines 84, 86 are of equal length. The line 84 extends to a point 90 on the line 60. The line 86 extends to a point 92 on the line 50. Between the lines 84, 86 is the letter, Q. Prior to the cards being dealt, the player has an option of making a card selection bet on a queen by placing cheques within the circle 25.

On the interior of the circle 21 are lines 94, 96 that intersect at a point 98 where the circle 23 is tangent to the circle 21. The lines 94, 96 are of equal length. The line 94 extends to a point 100 on the line 52. The line 96 extends to a point 102 on the line 32. Between the lines 94, 96 is the letter, K. Prior to the cards being dealt, the player has an option of making a card selection bet on a king by placing cheques within the circle 23.

It should be understood that the card selection bets on the ten, queen, king and ace are identical to the card selection bet on the jack described hereinbefore. In this embodiment, the card selection bets are structured to relate to a group of high ranking cards (ten, jack, queen, king, ace) and a group of low ranking cards (three, four, five, six). Many other structures are possible.

Although this embodiment describes the invention as a table game, it should be understood that the invention contemplates play on a slot machine and on the internet.

While the invention has been shown and described with reference to a preferred embodiment, it should be understood that changes in form and detail may be made therein without departing from the spirit and scope of the invention.

I claim:

1. A method of playing blackjack incorporating a side bet including:

accepting one or more player wagers on the blackjack game;

providing the one or more players with means for placing a side bet wherein an outcome of said side bet is dependent solely upon the value of a dealer's face up card;

dealing initially each of the one or more players two cards and the dealer one face down and one face up card pursuant to conventional blackjack rules;

determining whether the dealer's face up card has a value of ten;

if said face up card has a value of ten, paying the one or more players placing a side bet a winning amount;

if said face up card does not have a value of ten, all side bets being lost; and completing the blackjack game.

2. The method of claim 1 wherein said winning amount is two times the side bet.

3. The method of claim 1 wherein said means for placing the side bet is an arcuate-shaped betting area depicted on a blackjack table layout, said side bet being consummated by placing a chip, cheque, token, cash or similar wagering device in said betting area.

4. The method of claim 1 including an additional step of providing means for the one or more players to place a bonus bet that is rewarded when either one or both of the cards initially dealt to the one or more players corresponds to at least one of two predetermined ranks of a predetermined card suit, winning and losing said bonus bet being dependent solely on the rank and suit of the two cards dealt to each of the one or more players.

5. The method of claim 4 wherein said blackjack is dealt from a single standard deck of cards.

6. The method of claim 5 wherein said bonus bet contemplates two unique winning combinations, a first winning combination wherein one dealt card corresponds to one of the two predetermined ranks of the predetermined suit and a second winning combination wherein the two dealt cards correspond to the two predetermined ranks of the predetermined suit.

7. The method of claim 6 wherein the first winning combination provides for a 6 to 1 payout and the second winning combination provides for a 500 to 1 payout.

8. The method of claim 4 wherein said blackjack is dealt from multiple standard decks of cards shuffled together.

9. The method of claim 8 wherein said bonus bet contemplates three unique winning combinations, a first winning combination wherein one dealt card corresponds to one of the two predetermined ranks of the predetermined suit, a second winning combination wherein both dealt cards correspond to one of the two predetermined ranks of the predetermined suit, and a third winning combination wherein the two dealt cards correspond to the two predetermined ranks of the predetermined suit.

10. The method of claim 9 wherein the first winning combination provides for a 6 to 1 payout, the second winning combination provides for a 100 to 1 payout, and the third winning combination provides for a 500 to 1 payout.

* * * * *